US010104965B1

(12) United States Patent
Miller

(10) Patent No.: US 10,104,965 B1
(45) Date of Patent: Oct. 23, 2018

(54) TOILET PAPER HOLDER MOUNTED ADJUSTABLE BATHROOM SHELF

(71) Applicant: Patrick Earl Miller, McKinney, TX (US)

(72) Inventor: Patrick Earl Miller, McKinney, TX (US)

( * ) Notice: Subject to any disclaimer, the term of this patent is extended or adjusted under 35 U.S.C. 154(b) by 0 days.

(21) Appl. No.: 15/942,477

(22) Filed: Mar. 31, 2018

Related U.S. Application Data

(60) Provisional application No. 62/562,418, filed on Sep. 23, 2017.

(51) Int. Cl.

| | |
|---|---|
| ***A47B 96/02*** | (2006.01) |
| ***A47K 10/18*** | (2006.01) |
| *A47K 10/38* | (2006.01) |
| *D06F 57/12* | (2006.01) |
| *A47K 10/04* | (2006.01) |

(52) U.S. Cl.
CPC ..... *A47B 96/024* (2013.01); *A47B 96/025* (2013.01); *A47K 10/18* (2013.01); *A47K 10/04* (2013.01); *A47K 2010/389* (2013.01); *D06F 57/12* (2013.01)

(58) Field of Classification Search
CPC .... A47B 96/024; A47B 96/025; A47K 10/18; A47K 2010/389; A47K 10/04; D06F 57/12
USPC ... 211/16, 119.003, 126.1, 126.12, 135, 134, 211/162, 175, 153, 119.009; 242/596.8, 242/597.8, 598.5; 108/42, 44–46, 157.1, 108/157.11, 157.13, 157.15, 159.11; 248/241, 244, 309.2; 225/39, 46; 221/33–63
See application file for complete search history.

(56) References Cited

U.S. PATENT DOCUMENTS

| | | | | | |
|---|---|---|---|---|---|
| 346,154 | A * | 7/1886 | Hadley | A47K 10/40 | 242/599 |
| 464,378 | A * | 12/1891 | Morgan | A47K 10/38 | 242/596.8 |
| 758,545 | A * | 4/1904 | Mahoney | A47B 96/061 | 248/241 |
| 953,857 | A * | 4/1910 | Reynolds | A47B 96/061 | 248/241 |
| 1,064,843 | A * | 6/1913 | Marsh | A47B 96/061 | 108/152 |
| 1,702,937 | A * | 2/1929 | Friedemann | A47F 3/12 | 248/242 |
| 2,331,791 | A * | 10/1943 | Noel | A47K 10/38 | 225/77 |
| 2,647,641 | A * | 8/1953 | Tritt | A47K 10/10 | 211/123 |
| 2,832,549 | A * | 4/1958 | Youngberg | A47K 10/38 | 225/69 |
| 3,090,572 | A * | 5/1963 | Metcalf | A47K 10/40 | 242/156 |
| 3,096,731 | A * | 7/1963 | Lehman | A47K 10/04 | 108/29 |
| 3,233,744 | A * | 2/1966 | Ripps | A47K 1/09 | 108/24 |

(Continued)

*Primary Examiner* — Jonathan Liu
*Assistant Examiner* — Devin K Barnett

(57) ABSTRACT

A bathroom shelf, with adjustable tabs to fit on toilet paper dispensers, that rests on the toilet paper roller and over the toilet paper roll. The shelf does not require any tools or additional hardware to install.

2 Claims, 2 Drawing Sheets

(56) References Cited

U.S. PATENT DOCUMENTS 3,319,855 A * 5/1967 Tucker ..... A47K 10/38 225/67
3,943,859 A * 3/1976 Boone ..... A47K 10/32 108/27
4,159,071 A * 6/1979 Roca ..... A47C 7/70 108/42
4,191,317 A * 3/1980 Harkins ..... A47K 10/38 225/46
4,483,491 A * 11/1984 Rainey ..... A47K 10/38 242/129.6
4,520,968 A * 6/1985 Shpigelman ..... A47K 10/38 225/47
4,589,349 A * 5/1986 Gebhardt ..... A47B 96/025 108/102
4,620,489 A * 11/1986 Albano ..... A47B 96/025 108/105
4,646,658 A * 3/1987 Lee ..... A47B 96/025 108/137
4,669,692 A * 6/1987 Mastrodicasa ..... A47B 46/00 211/134
4,713,949 A * 12/1987 Wilcox ..... A47B 45/00 108/102
4,799,432 A * 1/1989 Rickner ..... A47B 95/008 108/42
4,827,849 A * 5/1989 Vignale ..... A47B 96/027 108/29
4,870,907 A * 10/1989 McKee ..... A47B 96/027 108/42
D305,488 S * 1/1990 Korpijaako ..... D6/523
5,213,245 A * 5/1993 Puaatuua ..... B65H 35/002 225/19
5,248,105 A * 9/1993 Cooker ..... A47K 10/38 242/598.5
5,268,149 A * 12/1993 Arafat ..... B01L 9/00 206/560
5,311,986 A * 5/1994 Putz ..... A47K 10/32 206/233
5,363,773 A * 11/1994 Chuang ..... A47B 45/00 100/115
5,433,152 A * 7/1995 Henry ..... A47B 96/028 108/42
5,464,170 A * 11/1995 Mitchell ..... A47K 10/40 242/598
5,618,008 A * 4/1997 Dearwester ..... A47K 10/32 242/594.5
5,623,880 A * 4/1997 Kuntz ..... A47K 10/38 108/42
5,638,966 A * 6/1997 Kuntz ..... A47K 10/40 211/153
5,716,113 A * 2/1998 Plourde ..... A47B 96/025 222/160
5,752,622 A * 5/1998 Abell ..... A47K 10/38 221/281
5,853,164 A * 12/1998 Hunt ..... B21F 9/00 254/213
5,868,335 A * 2/1999 Lebrun ..... A47K 10/38 242/560.3
5,921,410 A * 7/1999 Emery ..... A47B 43/00 108/42
6,123,303 A * 9/2000 Huang ..... A47B 57/482 211/90.02
6,230,953 B1 * 5/2001 Simhaee ..... B26F 3/002 225/46
6,244,448 B1 * 6/2001 Hang ..... A47K 10/04 211/104
6,357,609 B1 * 3/2002 Van Noord ..... A47B 45/00 108/65
6,427,606 B1 * 8/2002 Klotz ..... A47B 96/027 108/42
6,476,365 B1 * 11/2002 Rios ..... A47K 10/38 219/521
6,497,345 B1 * 12/2002 Wilker ..... A47K 10/32 222/130
6,505,800 B1 * 1/2003 Abdullah ..... A47B 96/061 135/913
6,561,364 B1 * 5/2003 Brunsden ..... A47B 96/027 211/86.01
6,592,013 B1 * 7/2003 Fujiwara ..... A47K 10/38 225/39
6,629,617 B2 * 10/2003 Osawa ..... A47F 5/16 211/119.003
D487,858 S * 3/2004 Richardson ..... D6/523
6,866,157 B2 * 3/2005 Shone ..... A47B 55/02 211/105.1
6,883,695 B2 * 4/2005 Orihara ..... A47K 10/38 225/46
7,207,448 B1 * 4/2007 Marino, Jr. ..... B25H 3/023 100/54
7,380,689 B2 * 6/2008 Parietti ..... A47K 10/42 221/282
7,530,526 B1 * 5/2009 Powers ..... A47K 10/38 242/422.5
8,210,365 B2 * 7/2012 Van Wyk ..... A47B 81/00 211/85.3
8,261,920 B1 * 9/2012 Matthews ..... A47B 5/02 108/42
8,474,504 B2 * 7/2013 Vulpitta ..... B65H 35/0033 156/486
8,783,474 B2 * 7/2014 Kuhlman ..... B60N 3/02 211/113
8,910,826 B2 * 12/2014 Rapala ..... A47K 10/185 206/233
2002/0171003 A1 * 11/2002 Johnson ..... A47K 10/38 242/598.3
2003/0019824 A1 * 1/2003 Gray ..... A47B 57/30 211/26
2003/0136749 A1 * 7/2003 Williams ..... H05K 7/183 211/26
2004/0108427 A1 * 6/2004 Chen ..... A47B 57/40 248/244
2004/0206651 A1 * 10/2004 Saito ..... A47K 10/3836 206/389
2006/0124567 A1 * 6/2006 Bove ..... A47J 43/18 211/125
2006/0169732 A1 * 8/2006 Ludvigsen ..... B26F 3/02 225/46
2008/0142542 A1 * 6/2008 Petry ..... A47K 10/38 221/283
2008/0308512 A1 * 12/2008 Knepfle ..... A47K 10/04 211/119.009
2012/0091251 A1 * 4/2012 Smith ..... A47K 10/40 242/596.4
2012/0261436 A1 * 10/2012 Farrell ..... A47K 10/3836 221/199
2012/0314353 A1 * 12/2012 Williams ..... A47G 23/0208 361/679.01
2013/0181102 A1 * 7/2013 Tooley ..... A47B 96/06 248/205.3
2015/0260446 A1 * 9/2015 Levie ..... F25D 25/021 211/126.1
2016/0280422 A1 * 9/2016 Dorrance ..... A47K 17/00
2017/0027395 A1 * 2/2017 Prior ..... A47K 10/40
2017/0156493 A1 * 6/2017 Trujillo ..... A47B 46/00
2018/0014701 A1 * 1/2018 Kennedy ..... A47K 10/32
2018/0084907 A1 * 3/2018 Chen ..... H05K 7/1489

* cited by examiner

TOILET PAPER HOLDER MOUNTED ADJUSTABLE BATHROOM SHELF

CROSS REFERENCE

Related to provisional application No. 62/562,418 was filed on Sep. 23, 2017 with the title: Toilet Paper Holder Mounted Adjustable Bathroom Shelf.

BACKGROUND OF THE INVENTION

The invention relates to an assembly that provides a shelf to place objects carried into the bathroom. Toilets can be in a separate part of a bathroom or in a powder bath, where space is limited for adding shelves or tables to place items carried into the bathroom. When using the bathroom, it can be convenient to have a place to put items carried into the bathroom. Existing fixtures in the bathroom like the toilet tank or toilet paper roll do not provide a flat stable surface to place items and placing items on the floor can create slip hazards or damage to the item.

There are devices like shelves that can be installed in a bathroom, but these can decrease freedom of movement where space is limited and can require the installation of additional hardware to support the shelves. There are devices that are all-in-one units containing a place to put small items and a built-in toilet paper holder, but these require removing the existing toilet paper holder and installing the all-in-one unit which could require additional hardware and installation time. Tables can also be added next to the toilet, but these use more of what could already be limited space in the bathroom.

Although the devices in the above paragraph do provide a place to put items taken into the bathroom, they do not provide the same level of convenience, proximity to the toilet, use of bathroom space, ease of installation and removal when the toilet paper roll needs to be replaced, as the present invention the Toilet Paper Holder Mounted Adjustable Bathroom Shelf.

BRIEF SUMMARY OF THE INVENTION

It is an object of the invention to provide a place to put items taken into the bathroom. More particularly, the invention is meant to make use of an existing wall mounted toilet paper holder. The invention is adjustable to allow it to fit toilet paper holders of various post depths and sizes.

The invention when installed is placed over the toilet paper roll and sits on the existing toilet paper holder's roller. The use of the word roller is not confined to a cylindrical roller, but rather any horizontal piece that the toilet paper roll is installed on.

The shelf requires no tools or additional hardware to install.

The shelf may need to be adjusted one time with the use of the fastening mechanisms on the tabs which are located on either side of the assembly. Once adjusted the assembly is placed over the toilet paper and rests on the toilet paper roller. When the toilet paper needs to be replaced, the assembly is lifted off of the roller allowing the toilet paper to be changed as it usually is. The shelf is then returned to sit over the newly replaced toilet paper roll.

The shelf assembly uses the existing toilet paper roller for vertical support, and by means of the adjustable tabs the shelf is held firmly in place horizontally between the roller and the back of the toilet paper holder or bathroom wall.

The back of the assembly provides stability by preventing the shelf from tipping forward when the assembly is correctly installed and an item is placed on the shelf.

To the accomplishment of the above and related objects the invention may be embodied in the form illustrated in the accompanying drawings. Attention is called to the fact, however, that the drawings are illustrative only. Variations are contemplated as being part of the invention.

BRIEF DESCRIPTION OF THE DRAWINGS

The above and other aspects, features and advantages of the present invention will be more apparent from the following detailed description thereof, which is presented in conjunction with the following drawings, wherein corresponding reference characters indicate corresponding components throughout the drawing figures.

DETAILED DESCRIPTION OF THE INVENTION

Figure 1:
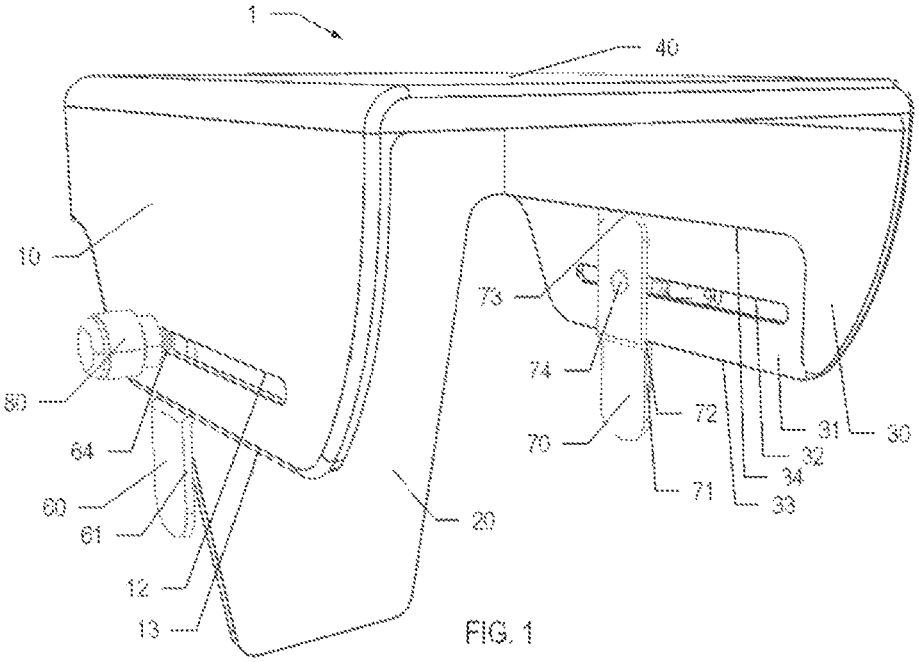
FIG. 1 is a perspective view of the adjustable shelf, viewed from the front left. This view is also offered as the front-page view.
Figure 2:
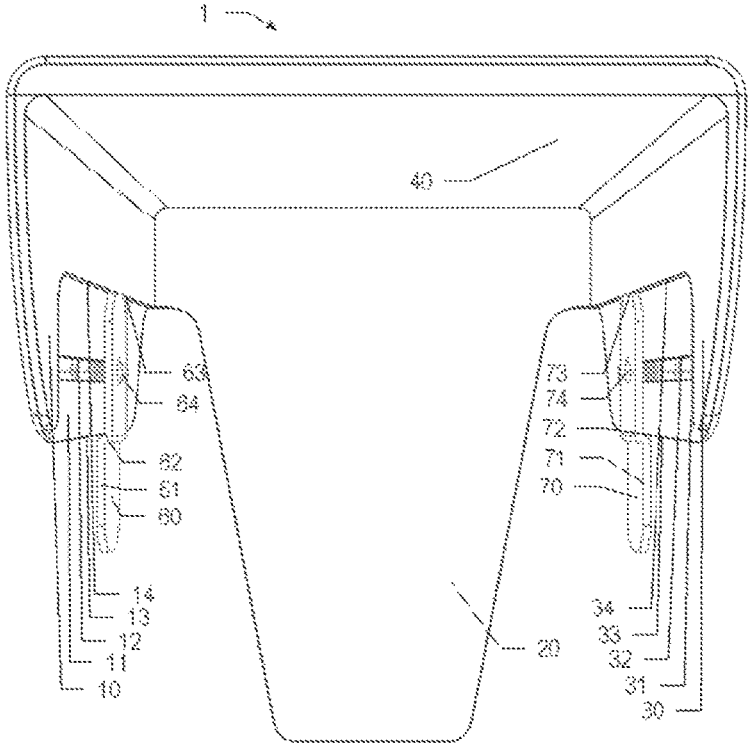
FIG. 2 is a perspective view of the adjustable shelf, viewed from the front.

FIGS. 1-2 show the shelf assembly 1 that provides a place to put items taken into a bathroom. According to the invention, the shelf assembly 1, is comprised of a left support side 10, a back-stabilizing side 20, a right support side 30, and top 40.

The left support side 10, is the point of attachment for adjustable tab 60, which slides in the recessed area 11. Recessed area 11 provides an upper guide ridge 14 for the top of the tab 63 to move along, and a lower guide edge 13 for the tabs middle ledge 62 to move along. The adjustable tab 60 is held in place by tightening the adjustment knob 80 on threaded post 64, which is an integral part of tab 60, and moves within slot 12. Adjustment of the adjustable tab 60 is accomplished by resting the bottom edge 13 of left side 10, and the bottom edge 33 of right side 30, on the roller of the existing toilet paper roller, and sliding the assembly 1 so that the back side 20 is against the bathroom wall or vertical back of the existing toilet paper holder. Adjustment knob 80 is loosened on the threaded post 64 so that the adjustable tab 60 can be moved in slot 12 until the front edge of the tab 61 is against the back of the existing toilet paper roller. To be properly installed the adjustable tab 60 must be between the existing toilet paper roller and the bathroom wall or vertical back of the toilet paper holder, and the adjustment knob 80 tightened on threaded post 64. An installed assembly can be seen depicted in FIGS. 3 and 4.

Back side 20 is a stabilizing element that helps prevent the shelf from tipping forward when the shelf assembly is correctly installed on the existing toilet paper roller.

The right support side 30, is the point of attachment for adjustable tab 70, which slides in the recessed area 31. Recessed area 31 provides an upper guide ridge 34 for the top of the tab 73 to move along, and a lower guide edge 33 for the tabs middle ledge 72 to move along. The adjustable tab 70 is held in place by tightening the adjustment knob 90 on threaded post 74, which is an integral part of tab 70, and moves within slot 32. Adjustment of the adjustable tab 70 is accomplished by resting the bottom edge 33 of right side 30, and the bottom edge 13 of left side 10, on the roller of the existing toilet paper roller, and sliding the assembly 1 so that the back side 20 is against the bathroom wall or vertical back of the existing toilet paper holder. Adjustment knob 90 is loosened on the threaded post 74 so that the adjustable tab 70 can be moved in slot 32 until the front edge of the tab 71 is against the back of the existing toilet paper roller. To be properly installed the adjustable tab 70 must be between the existing toilet paper roller and the bathroom wall or vertical back of the toilet paper holder, and the adjustment knob 90 tightened on threaded post 74. An installed assembly can be seen depicted in FIGS. 3 and 4.

Top 40 provides the assembly's surface where items can be placed that have been brought into the bathroom The parts of the assembly consisting of sides 10 and 30, back 20, and top 40 can be made out of any material that provides sufficient rigidity to be stable when in use, for example plastics, wood, metal or any composite material. A contemplated material and process are to produce parts 10,30,20 and 40 as one piece through a plastic injection molding process.

The adjustable tabs, 60 and 70, and integrated threaded posts, 64 and 74, can be made out of any material that provides sufficient strength and rigidity to allow the adjustment knobs 80 and 90 to securely hold the adjustable tabs 60 and 70 in place. Examples of materials for the tab include: plastics, wood, metal or any composite material. Materials for the threaded post 64 and 74, could for example be made of plastic, metal or any composite material.

Adjustment knobs, 80 and 90, can be made out of any material that provides sufficient strength and rigidity to allow the adjustment knobs to be secured on threaded posts, 64 and 74, to securely hold adjustable tabs, 60 and 70, in place.

Figure 3:
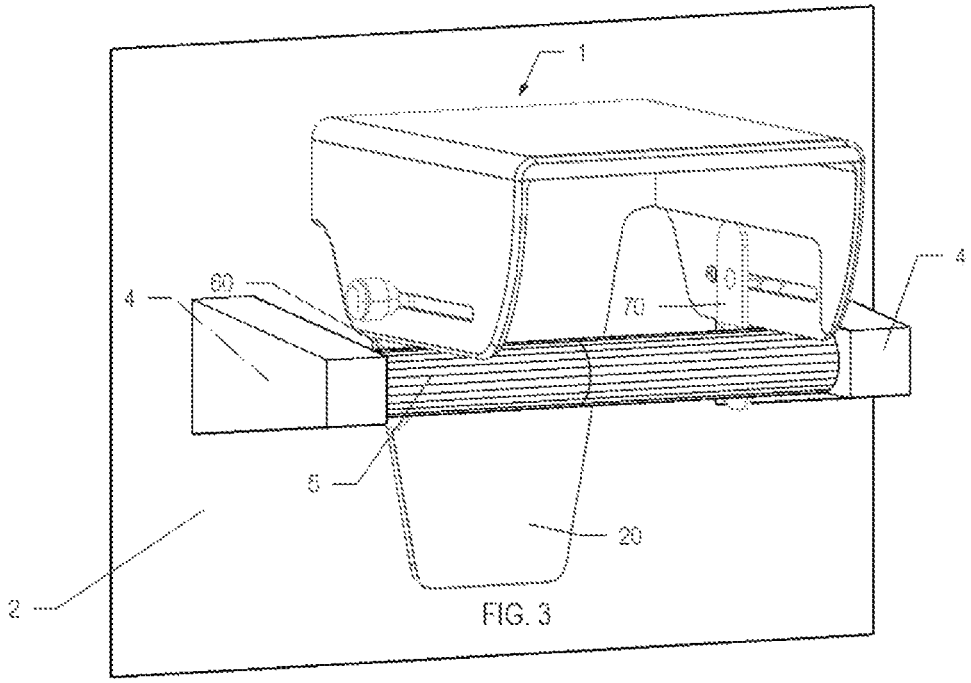
FIG. 3 is a perspective view of the adjustable shelf installed on a wall mounted toilet paper holder.

FIG. 3 shows the shelf assembly 1 mounted on an existing toilet paper holder 2, consisting of the toilet paper holder posts 4 and roller 5, with the correct placement of the adjustable tabs 60 and 70 behind the roller, and the back 20 against the bathroom wall or back of the existing toilet paper holder.

Figure 4:
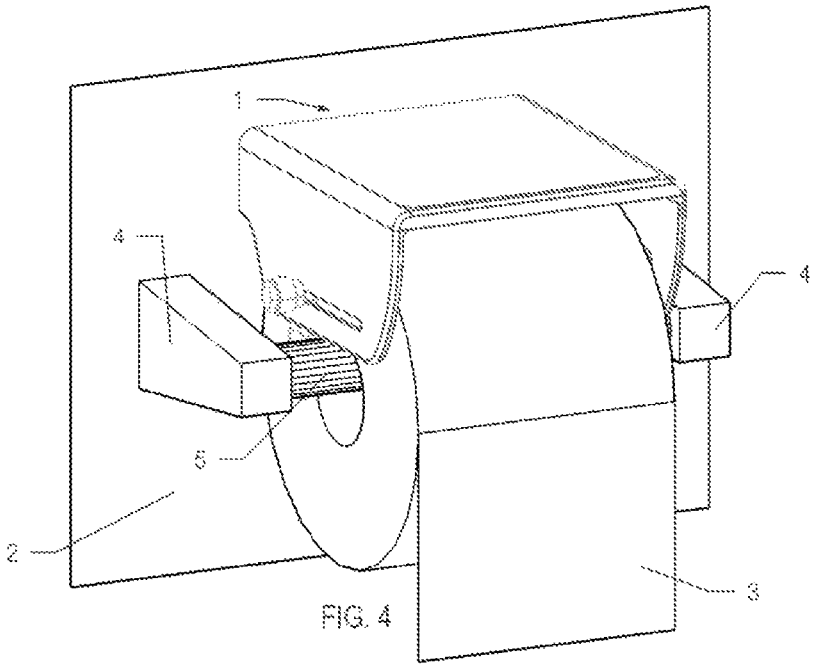
FIG. 4 is a perspective view of the adjustable shelf installed on a wall mounted toilet paper holder with a toilet paper roll.

FIG. 4 shows the shelf assembly 1 mounted on an existing toilet paper holder 2, consisting of the toilet paper holder posts 4, roller 5, and a toilet paper roll 3 to provide a view of the shelf assembly 1 as it would look when installed.

Many specific details contained in the above description merely illustrate some preferred embodiments and should not be construed as a limitation on the scope of the invention. Accordingly, many other variations are possible within the spirit of the present invention.

What is claimed is:

1. An adjustable shelf for storing items, the adjustable shelf is configured to be mounted on an existing toilet paper holder and does not require any tools or additional hardware to install, comprising:

a planar top surface for storing the items thereon, a back wall, a right side wall and a left side wall, wherein the back wall and each side wall extends downwardly from the top surface at a generally perpendicular angle;

wherein each side wall has a horizontal slot formed therein and a bottom surface that is configured to rest on a roller of the existing toilet paper holder;

a pair of adjustable tabs extending downwardly below the bottom surfaces of the side walls, wherein a first adjustable tab from said pair of adjustable tabs has a first threaded post protruding therefrom that is inserted within the horizontal slot of the right side wall to slidably mount the first adjustable tab to the right side wall;

wherein a second adjustable tab from said pair of adjustable tabs has a second threaded post protruding therefrom that is inserted within the horizontal slot of the left side wall to slidably mount the second adjustable tab to the left side wall;

wherein each threaded post has an adjustment knob screwed on a distal end thereof to hold each adjustable tab securely in place;

wherein the adjustable tabs provide tension to hold the shelf firmly between the toilet paper roller and a back of the existing toilet paper holder or a bathroom wall;

wherein when the adjustable shelf is placed on the existing toilet paper holder the back wall is configured to extend substantially below the existing toilet roll holder to prevent the shelf from flipping forward when the shelf has the items placed thereon.

2. The adjustable shelf of claim 1, wherein each threaded post has a proximal end opposite the distal end of each threaded post;

wherein each proximal end of each threaded post is generally co-planar with an interior surface of the respective adjustable tabs.

* * * * *